US005257581A

United States Patent [19]

Welling

[11] Patent Number: 5,257,581

[45] Date of Patent: Nov. 2, 1993

[54] REMOTELY CONTROLLED LOCKING ARRANGEMENT FOR SAFES

[76] Inventor: Al Welling, 1605 S. Hood, Alvin, Tex. 77511

[21] Appl. No.: 941,214

[22] Filed: Sep. 4, 1992

[51] Int. Cl.[5] ..... E05G 1/00

[52] U.S. Cl. ..... 109/24; 292/251.5; 292/259 R; 70/278

[58] Field of Search ..... 109/23, 24, 49.5, 58, 109/59 R, 59 T; 292/251.5, 259 R; 70/1, 1.5, 2, 77, 78, 91, 94, 416, 276-278, 282

[56] References Cited

U.S. PATENT DOCUMENTS

| | | | |
|---|---|---|---|
| 1,882,339 | 10/1932 | Richards | 292/259 X |
| 2,163,206 | 6/1939 | Lopez | 292/259 |
| 3,665,736 | 5/1972 | Wilson | 292/259 R X |
| 3,986,741 | 10/1976 | Giovannini | 292/259 R X |
| 4,331,355 | 5/1982 | Okuno | 292/251.5 |
| 4,418,551 | 12/1983 | Kochakis | 292/259 R X |
| 4,696,500 | 9/1987 | Zunkel | 292/251.5 |
| 4,762,350 | 8/1988 | Hurtado | 292/259 R |
| 4,796,384 | 1/1989 | Warwick | 292/302 X |
| 4,991,887 | 2/1991 | Hahn | 292/251.5 |
| 5,141,271 | 8/1992 | Geringer et al. | 292/251.5 |

FOREIGN PATENT DOCUMENTS

| | | | |
|---|---|---|---|
| 1179194 | 12/1958 | France | 292/251.5 |
| 576369 | 3/1958 | Italy | 109/24 |
| 67132 | 4/1925 | Sweden | 109/24 |

*Primary Examiner*—Peter M. Cuomo
*Assistant Examiner*—Suzanne L. Dino
*Attorney, Agent, or Firm*—Jacobson, Price, Holman & Stern

[57] ABSTRACT

A safe locking assembly allows a safe to be securely locked and to be unlocked from a remote location. The attachment has arms attached to opposite side walls of the safe and a swing arm at the front to extend across the safe door. The swing arm is attracted to one side arm by an electromagnet which prevents the swing arm from swinging open to obtain access to the safe door. The electromagnet can be deactivated by a remote switch to allow the swing arm to open and provide access to the safe. The device is useful for safes to which access is needed on a frequent basis to obviate the need for operating the safe's own combination or other lock each time the safe is to be opened and closed.

10 Claims, 1 Drawing Sheet

REMOTELY CONTROLLED LOCKING ARRANGEMENT FOR SAFES

BACKGROUND OF THE INVENTION

This invention relates to a remotely controlled locking arrangement for safes.

Business concerns such as jewelry stores, pawnbrokers and the like frequently keep valuable merchandise in a safe which may be located in a back room of the business, and to which access is needed at frequent intervals during a business day. Commonly, this means operating a combination lock or a key-type lock each time the safe is to be opened and closed and this can become burdensome if access to the safe is needed on a frequent basis. There is a tendency therefore to leave such safes open and unattended during parts of a business day, and this presents a security risk.

SUMMARY OF THE INVENTION

It is an object of the invention to provide a locking assembly for a safe which can be used to provide quick, simple, and secure locking and unlocking of the safe without having to use the combination or other lock with which the safe is equipped.

Another object of the invention is to provide an assembly, as above, which can be operated remotely so that, for example, a safe in the back room of a store can be opened from the front of the store by authorized personnel.

Still another object of the invention is to provide an assembly, as above, which is simple to secure to a safe and which can be supplied in the form of a kit for in situ use.

Yet another object of the invention is to provide an assembly, as above, which can be used on different size safes.

In fulfillment of the above and other objects, the invention, at least in one embodiment thereof, provides a safe locking assembly comprising a first arm for attachment to one side wall of a safe to extend to the front of the safe, a second arm for attachment to an opposite side wall of the safe also to extend to the front of the safe, a third arm to extend across the door of the safe, a hinge means for connecting one end of the third arm to a forward end of the first arm; an electromagnetic attraction unit (electromagnet and attractable element) for use between a forward end of the second arm and a free end of the third arm to secure the free end of the third arm to the forward end of the second arm by electromagnetic attraction with an attraction force sufficient to prevent the third arm from being pulled manually away from the second arm when the electromagnetic is energized, wiring means for delivering electrical energy to the electromagnet and deactuator means for terminating the delivery of electrical energy to the electromagnet whereby the third arm can be swung away from the second arm allowing the safe door to be opened.

Conveniently, the electromagnet is secured at the forward end of the second arm with the attractable element, such as a metal plate, on the free end of the third arm. Wiring for the electromagnet may extend through the second arm to the back of the safe and may thence extend through a wall or other concealment to a transformer, and a plug for connecting same into a mains supply. The wiring may include an on/off switch for the power supply, the deactuator means, which can be positioned remotely from the safe, for example, if the safe is located in the back room of a store, the switch can be located at the front of the store.

With the above arrangement, the conventional lock on the safe, be it a combination lock or a key lock can be left open during a business day, and the safe can be left locked by means of the inventive attachment through the supply of electricity to the electromagnet. Preferably, the hinge arrangement is of the spring-hinge type and the switch controlling the electromagnet is of the plunger or like type which cuts off supply to the electromagnet only when depressed. Then, when access to the safe is needed, the switch is depressed allowing the spring-type hinge to swing the third arm away from the safe door. This can be done remotely from the safe. When loading or unloading of the safe has been completed, the third arm can be swung manually back into engagement with the live electromagnet against the spring action. Thus, the safe is opened remotely but closed and locked in situ.

In a preferred form of the invention, the arms may be telescopic to fit different size safes and the first and second arms may be adhered to the side walls of a safe by industrial strength epoxy or the like.

In place of a switch for controlling the electromagnet, it can be arranged that the electromagnet is deactuable by a portable radio-wave controller.

DESCRIPTION OF PREFERRED EMBODIMENT

Figure 1:
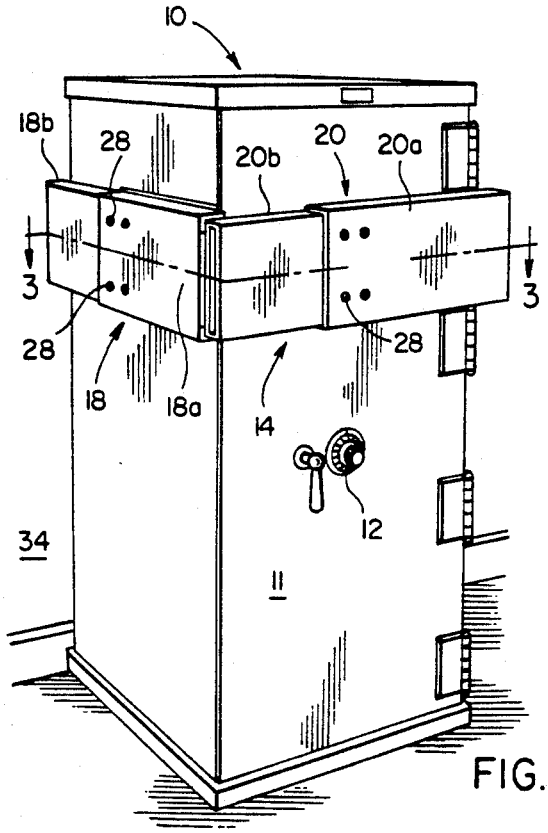
FIG. 1, is a perspective view of a safe equipped with a locking attachment according to the invention with the attachment shown in the locked position.

The drawings show a conventional safe 10, which may be a jeweler's or pawnbroker's safe, and which for illustrative purposes is provided with a closure in the form of a door 11 with a combination lock 12, although the invention is applicable to safes with other forms of lock. In order to obviate the need for using the lock 12 whenever the safe is opened during a business day, the safe is equipped with a locking assembly 14 according to the invention.

The locking assembly comprises a first attachment in the form of a telescopic arm 16 with sections 16*a*, 16*b* adhesively secured to one side wall of the safe and extending to the front of the safe, a second attachment in the form of a telescopic arm 18 with sections 18*a*, 18, adhesively secured to the opposite side wall of the safe, and a third telescopic swing arm 20, with sections 20*a*, 20*b* attached at one end to the front of arm 16 by spring hinges 22. The respective telescopic sections of each arm comprise box-section hollow metal sleeves with wooden re-enforcing ribs 24 at the ends. The arms 16 and 18 are adhered to the safe walls by marine epoxy 26. When the arms are set to length, they may be fixed by non-reversing screws 28.

An electromagnet 30 is suitably secured, e.g., by adhesive in the forward end of arm 18 to form an electromagnetic attraction unit in conjunction with a metal plate 32 screwed onto the free end of the swing arm 20. Wiring 31 for the electromagnet extends back through arm 20 and exits behind the back of the safe. In order to conceal the wiring, section 20*b* of arm 20 extends back to a wall 34 behind the safe. Thence, the wiring 31 can be extended to a remote, normally closed, plunger-type switch 36, a transformer 38 and a mains connection plug 40. The electromagnet is preferably of a size to produce at least a 1000 lb pull so that when arm 20 is attracted to the electromagnet it cannot be pulled away manually. In use, the wiring 31 is preferably concealed throughout its length to prevent tampering which could deactivate the electromagnet.

Figure 2:
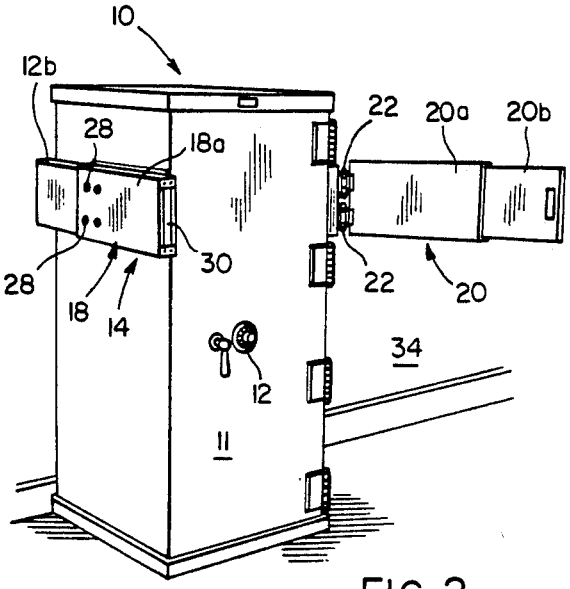
FIG. 2, is a view similar to FIG. 1 with the attachment shown in the unlocked position.
Figure 3:
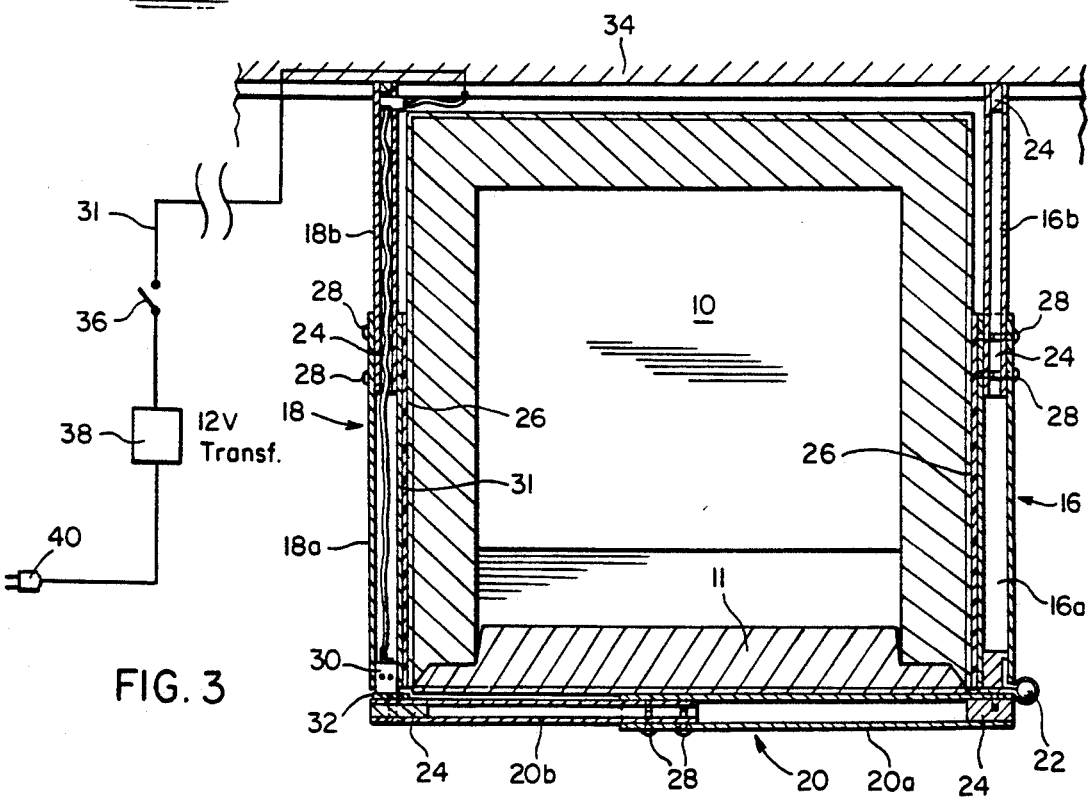
FIG. 3, is a sectional view on line 3—3 of FIG. 1.

As previously described, the locking assembly can be remotely released by depression of switch 36, which opens the electrical circuit energizing the transformer 38, and the spring hinges 22 will cause the arm 20 to swing open as shown in FIG. 2. Release of the switch re-activates the electromagnet so that when the swing arm 20 is manually returned to the closed position, the safe will again be locked.

The assembly can be supplied in kit form for in situ securement to a safe.

While only a preferred embodiment of the invention has been described herein in detail, the invention is not limited thereby and modifications can be made within the scope of the attached claims. For example, the electromagnet could be attached to arm 20 with the wiring extending through arms 20 and 16, and plate 32 could be on the front of arm 18. Also, while the description refers to the third arm of the attachment as extending across the front of the safe, the attachment can alternatively be arranged with the third arm extending over the top of a safe if the safe closure is at the top.

I claim:

1. In combination with a safe which has side walls and a third wall defining a lockable closure at the top or front of the safe, an auxiliary locking assembly in the form of an arm structure comprising plural arms encircling the side walls and third wall of the safe, said structure including side arms adhesively secured to the respective side walls of the safe, hinge means between a pair of adjacent arms of the structure for allowing one of said pair of arms to swing away from the third wall of the safe and allow the safe to be opened, an electromagnet unit comprising an electromagnet element and an attractable element, one of said elements being attached to a free end of said one of said pair of arms and the other of said elements being attached to another arm of the structure for securing said free end to said another arm when the electromagnet element is energized with a force sufficient to prevent said one of said pair of arms from being pulled manually away from said another arm, wiring for delivering electrical energy to the electromagnet element, said wiring extending through one of said side arms of the structure, said one of said side arms extending at least to a fourth wall of the safe, opposite said third wall, for concealment of the wiring, and deactuator means associated with said wiring at a location remote from the safe for terminating supply to electrical energy to the electromagnet element and enabling said one of said arms to be swung away from said another arm to open the safe.

2. A combination as defined in claim 1, wherein each of the arms comprises at least two telescopically interconnected sections enabling the length of the respective arm to be adjusted.

3. A combination as defined in claim 2 including fastener means for securing the respective arm section together.

4. A combination as defined in claim 1, wherein the hinge means comprises at least one spring hinge.

5. A combination as defined in claim 1, wherein said one of said side arms extends to a building wall behind said fourth wall of the safe, and said wiring leads out from said one of said side arms at a location between said building wall and said fourth wall of the safe.

6. A combination as defined in claim 1, wherein the electromagnet element when energized exerts a pull of at least 1000 lbs on the attractable element.

7. An auxiliary locking assembly for use in combination with a safe which has side walls and a third wall defining a lockable closure, said assembly comprising an arm structure having plural arms for encircling the side walls and third wall of the safe, said structure including side arms, adhesive means on the side arms for securing same to the respective side walls of the safe, hinge means between a pair of adjacent arms of the structure for allowing one of said pair of arms to be swung away from the third wall of the safe when the assembly is in use, an electromagnet unit comprising an electromagnet element and an attractable element, one of said elements being attached to a free end of said one of said pair of arms and the other of said elements being attached to another arm of the structure for securing said free end to said another arm when the electromagnet is energized with a force sufficient to prevent said one of said pair of arms from being pulled manually away from said another arm, wiring for delivering electrical energy to the electromagnet element, said wiring extending through one of the side arms of the structure, and deactuator means associated with said wiring for terminating supply of electrical energy to the electromagnet element from a location remote from the safe.

8. An assembly as claimed in claim 7, wherein each of the arms comprises at least two telescopically interconnected sections enabling the length of the respective arm to be adjusted to fit different size safes.

9. An assembly as claimed in claim 7, wherein the hinge means comprises at least one spring hinge.

10. An assembly as claimed in claim 7, wherein the electromagnet element when energized exerts a pull of at least 1000 lbs on the attractable element.

* * * * *